US006907812B1

(12) United States Patent
Eckstedt

(10) Patent No.: US 6,907,812 B1
(45) Date of Patent: Jun. 21, 2005

(54) POP-UP WEAPON SYSTEM

(75) Inventor: Paul D. Eckstedt, San Jose, CA (US)

(73) Assignee: United Defense LP, Arlington, VA (US)

( * ) Notice: Subject to any disclaimer, the term of this patent is extended or adjusted under 35 U.S.C. 154(b) by 0 days.

(21) Appl. No.: 10/349,393

(22) Filed: Jan. 21, 2003

(51) Int. Cl.[7] ..... F41A 23/00

(52) U.S. Cl. ..... 89/37.01; 89/38; 89/1.815; 89/1.8

(58) Field of Search ..... 89/37.01, 36.15, 89/38, 1.804, 1.815, 1.8

(56) References Cited

U.S. PATENT DOCUMENTS

| | | | | | |
|---|---|---|---|---|---|
| 2,348,796 | A | * | 5/1944 | Ferwerda et al. | 172/305 |
| 2,404,256 | A | * | 7/1946 | Tapp | 89/36.08 |
| 3,946,640 | A | * | 3/1976 | Baumann | 89/1.815 |
| 4,282,794 | A | * | 8/1981 | Miller et al. | 89/36.15 |
| 4,326,446 | A | * | 4/1982 | Magnuson | 89/38 |
| 4,501,190 | A | | 2/1985 | Hobson | |
| 5,056,409 | A | | 10/1991 | Allais et al. | |
| 5,129,308 | A | * | 7/1992 | Fuereder et al. | 89/36.15 |
| 5,452,640 | A | * | 9/1995 | Bovee et al. | 89/1.815 |
| 5,461,961 | A | * | 10/1995 | Baus et al. | 89/1.815 |
| 6,009,791 | A | | 1/2000 | Medlin | |
| 6,571,678 | B1 | * | 6/2003 | Bar | 89/41.02 |
| 6,584,881 | B1 | * | 7/2003 | Boudreau et al. | 89/1.804 |
| 6,742,433 | B2 | * | 6/2004 | Smith et al. | 89/1.815 |

* cited by examiner

*Primary Examiner*—Michael J. Carone
*Assistant Examiner*—M. Thomson
(74) *Attorney, Agent, or Firm*—Patterson, Thuente, Skaar & Christensen, P.A.

(57) ABSTRACT

A remote pop-up weapon system utilizes an elevating deck and a rotating gun base to allow the weapon(s) to be positioned in locations that are preferred over the locations available for traditional weapon systems. The use of the elevating deck allows the weapon station to "see" over buildings, trees, hills, and the like. This allows the crew of the vehicle, including the operators of the weapon system, to fully utilize available shielding or cover while remotely firing the weapons mounted on the elevating deck.

5 Claims, 3 Drawing Sheets

POP-UP WEAPON SYSTEM

BACKGROUND OF THE INVENTION

1. Field of the Invention

The present invention relates generally to military weapons, and more particularly is a pop-up weapon system for a military vehicle.

2. Description of the Prior Art

Traditionally, weapon stations on military vehicles or other structures are attached directly to the vehicle or a turret. While this is certainly a practical and convenient arrangement, the safety and survivability of the vehicle and a crew under attack are jeopardized when the weapon needs to be deployed. Typically, deployment of the weapon system requires that the system be positioned with exposure to the enemy for use. With a direct connection of the weapon system to a vehicle, exposure of the weapon system for deployment also entails exposure of the system to enemy attack.

Accordingly, it is an object of the present invention to provide a weapon system that has a ready position in which the system is separated from the vehicle or turret of a structure.

It is a further object of the present invention to provide a weapons system that can be operated without directly exposing the operators to the enemy.

It is a still further object of the present invention to provide a weapons system that can be aimed and fired while in an fully extended, deployed position.

SUMMARY OF THE INVENTION

The present invention is a remote pop-up weapon system. The weapon system of the present invention utilizes an elevating deck and a rotating gun base to allow the weapon (s) to be positioned in locations that are preferred over the locations available for traditional weapon systems.

The use of the elevating deck allows the weapon station to "see" over buildings, trees, hills, and the like. This allows the crew of the vehicle, including the operators of the weapon system, to fully utilize available shielding or cover while remotely firing the weapons mounted on the elevating deck.

An advantage of the present invention is that it provides greater safety for the crew of the vehicle and the operators of the weapons system.

Another advantage of the present invention is that it places the weapon system in a location removed from the critical motive components of the vehicle, thereby enabling the vehicle to remain operable even if the weapon system sustains damage or is destroyed.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
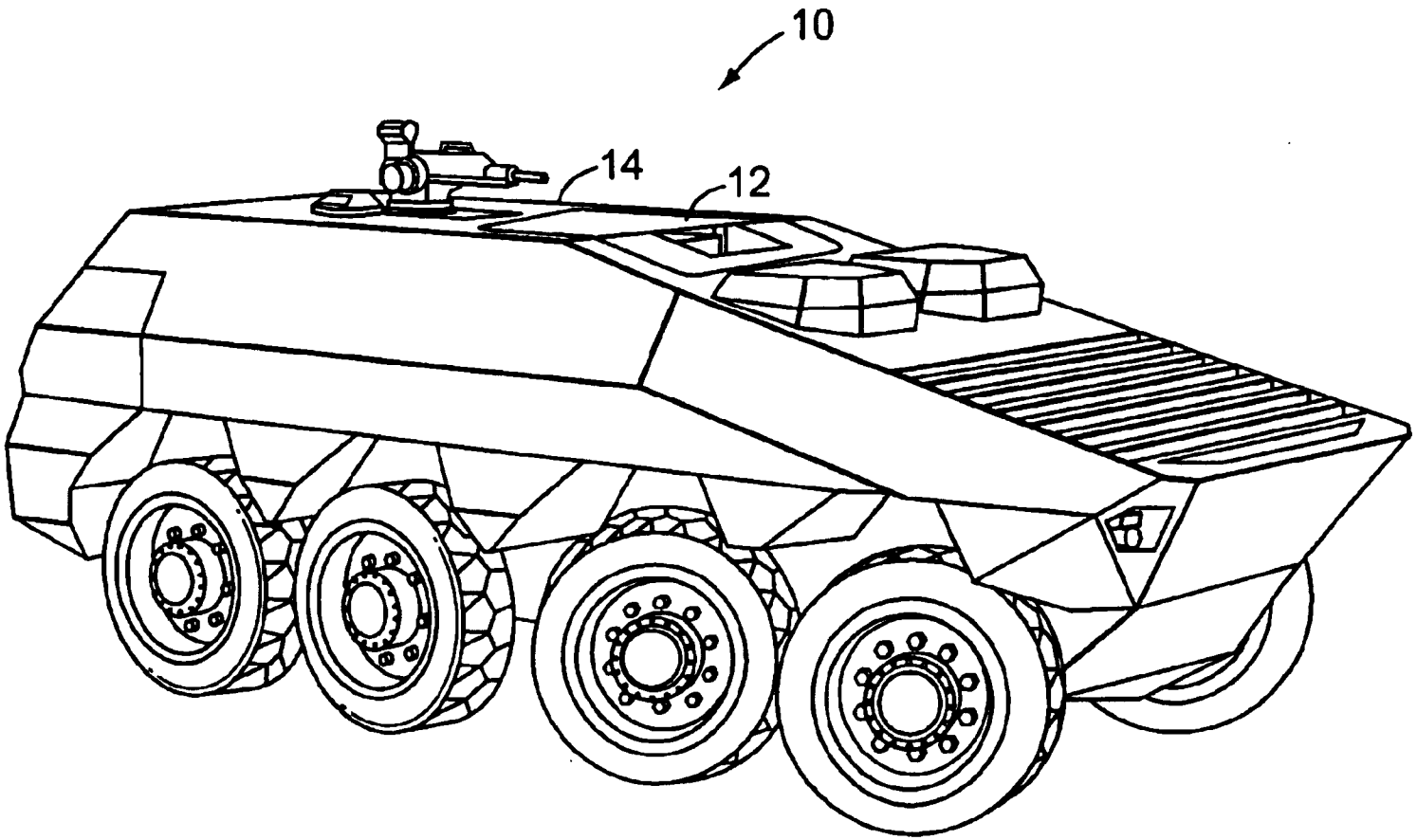
FIG. 1 is a perspective view of a military vehicle with the pop-up weapon system of the present invention in an at-rest position.
Figure 2:
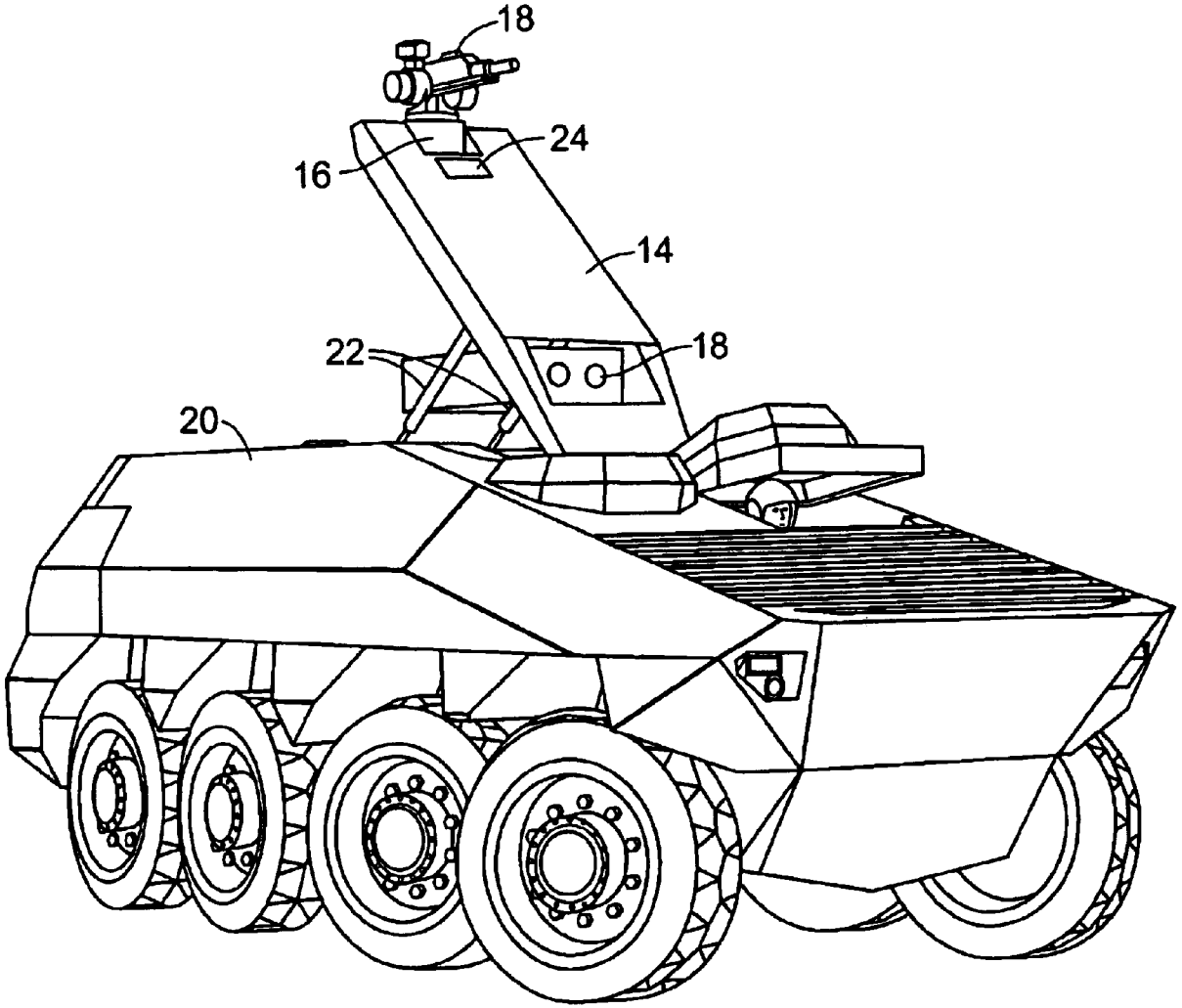
FIG. 2 is a front perspective view of the vehicle with the pop-up weapon system deployed.
Figure 3:
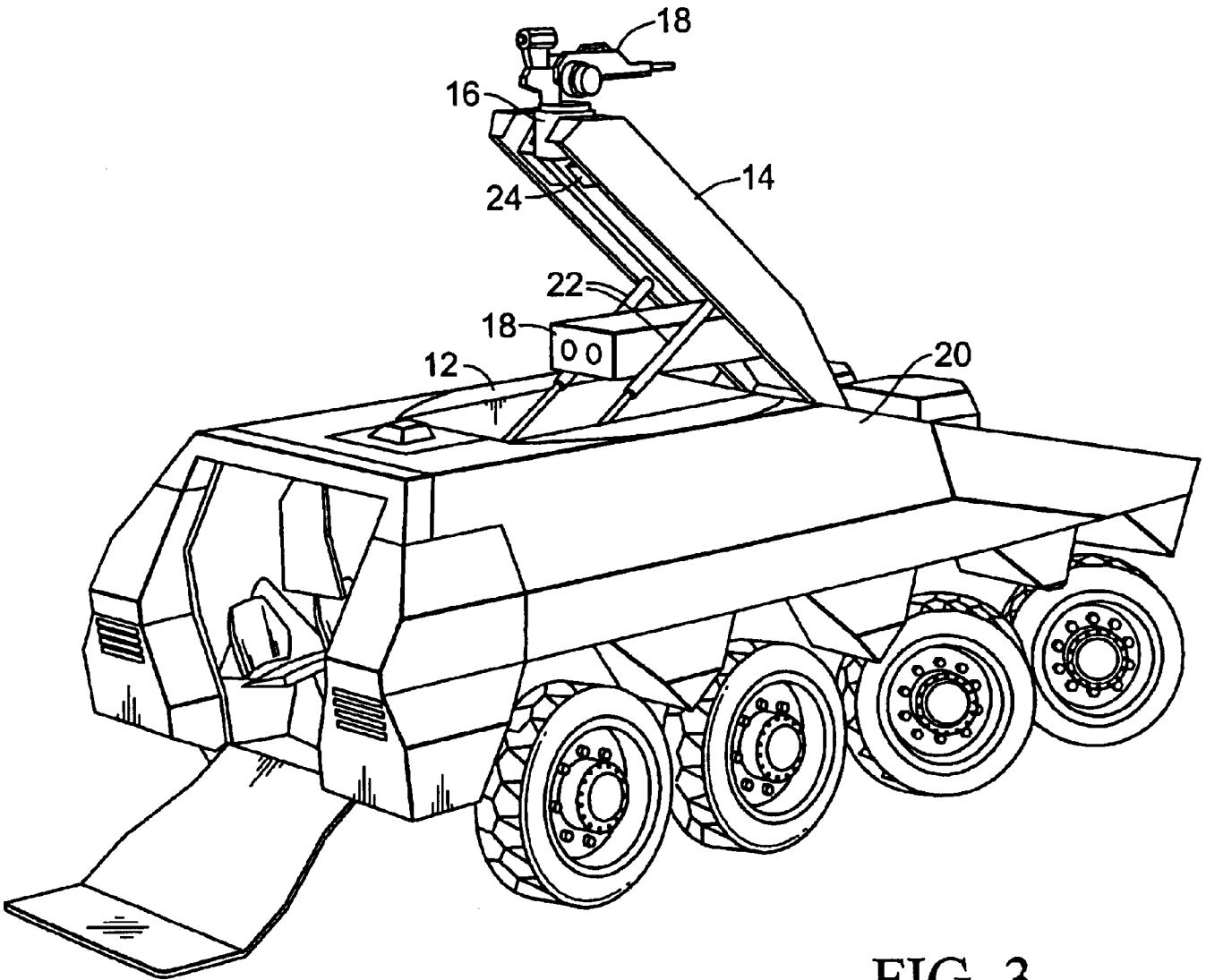
FIG. 3 is a rear perspective view of the vehicle with the pop-up weapon system deployed.

The present invention is a weapon system 10 with a remotely operated pop-up weapon station mounted on a rotating station base 12. The rotating station base 12 allows gross targeting of the weapons system 10. The weapon system 10 further comprises an elevating deck 14 mounted on the rotating station base 12. A rotating gun base 16 is provided for final targeting of one or more of the weapons 18 employed in the system 10.

The rotating station base 12 is mounted in a main hull 20 of the vehicle or other structure. One end of the elevating deck 14 is affixed by hinges to the rotating deck 12. The other end of the elevating deck 14 is raised by a pair of pneumatic or hydraulic cylinders 22 that serve as a means for lifting the elevating deck 14. The length of the elevating deck 14 and the position of a sensor and control module 24 is chosen so that when the deck 14 is fully extended, the sensor and control module 24 extends beyond the body of the vehicle. In conjunction with the rotation of the station base 12, the extension of the elevating deck 14 enables the vision sensors of the system 10 to "see" around and over various obstacles when the elevating deck 14 is raised and rotated.

Providing at least one of the weapons 18 (machine gun and TOW missile system shown) with the rotating gun base 16 provides the weapon system 10 with 360° coverage. The weapons 18 are loaded by an automated cartridge or feed system.

The system 10 further comprises a sensor and control module 24 that contains the vision sensor system. The sensor system in conjunction with an on board computer controls and fires the weapons system 10.

The rotational and elevating capabilities of the weapons system 10 enable the system 10 to be deployed in positions that are preferred over the locations available for traditional weapon systems. The weapon system 10 uses computer and vision systems to remotely operate the pop-up weapon station 12. This allows the crew and the critical motive components of the vehicle to remain protected from the enemy behind natural or man-made obstacles while the weapon system is in use. This factor is particularly important in operations conducted in villages or on city streets. This crew is able to peer around corners of buildings and at the same time fire upon enemy locations without ever exposing the vehicle to direct enemy fire.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A weapon system in combination with a military vehicle comprising:

a weapon station with at least one weapon;

a rotating station base rotatable when said weapon station is in a deployed position and when said weapon station is in a stowed position, an elevating deck, and remote controls to remotely operate said at least one weapon from within a hull of said vehicle; wherein said weapon station is mounted on said elevating deck such that said at least one weapon is contained within said hull of said vehicle to which said weapon station is attached when said weapon station is in a non-deployed position, and said elevating deck is hingedly affixed to said rotating station base, with means for lifting said elevating deck; such that when said means for lifting said elevating deck is activated, said elevating deck is rapidly raised about a single axis of rotation from said stowed position to said deployed position, thereby elevating said at least one weapon above said hull of said vehicle, such that said at least one weapon is fired from a position displaced from said rotating station base.

2. The weapon system of claim 1 wherein:

said at least one weapon is mounted on a rotating gun base, and said rotating gun base is mounted on said elevating deck.

3. The weapon system of claim 1 wherein:

said system further comprises a sensor and control module including vision sensors and computer controls.

4. The weapon system of claim 1 wherein:

said means for lifting said elevating deck is at least one pneumatic cylinder.

5. The weapon system of claim 1 wherein:

said means for lifting said elevating deck is at least one hydraulic cylinder.

* * * * *